US010203151B2

(12) United States Patent
Cizik et al.

(10) Patent No.: US 10,203,151 B2
(45) Date of Patent: Feb. 12, 2019

(54) DOMESTIC REFRIGERATION APPLIANCE WITH AN INDIVIDUALLY CREATABLE ADDITIONAL COMPARTMENT AND METHOD FOR THE FORMATION OF AN ADDITIONAL COMPARTMENT

(71) Applicant: BSH HAUSGERÄTE GmbH, München (DE)

(72) Inventors: Herbert Cizik, Ottenbach (DE); Jessica Dittmann, Lauchheim (DE); Andrea Fink, Gerstetten (DE); Claudia Weiβ, Neu-Ulm (DE); Marcus Wehlauch, Nattheim (DE); Felix Wiedenmann, Heidenheim (DE)

(73) Assignee: BSH Hausgeräte GmbH, Munich (DE)

( * ) Notice: Subject to any disclaimer, the term of this patent is extended or adjusted under 35 U.S.C. 154(b) by 17 days.

(21) Appl. No.: 15/341,337

(22) Filed: Nov. 2, 2016

(65) Prior Publication Data

US 2017/0122651 A1 May 4, 2017

(30) Foreign Application Priority Data

Nov. 2, 2015 (DE) ..... 10 2015 221 440
Oct. 19, 2016 (DE) ..... 10 2016 220 444

(51) Int. Cl.

| | |
|---|---|
| ***F25D 23/06*** | (2006.01) |
| ***F25D 25/00*** | (2006.01) |
| ***F25D 17/06*** | (2006.01) |
| ***F25D 11/02*** | (2006.01) |
| ***F25D 17/04*** | (2006.01) |

(Continued)

(52) U.S. Cl.

CPC ..... *F25D 25/005* (2013.01); *F25D 11/02* (2013.01); *F25D 17/042* (2013.01); *F25D 17/06* (2013.01); *F25D 23/069* (2013.01); *F25D 23/08* (2013.01); *F25D 25/025* (2013.01); *F25D 23/067* (2013.01); *F25D 25/04* (2013.01); *F25D 2317/061* (2013.01); *F25D 2317/0664* (2013.01); *F25D 2400/16* (2013.01); *F25D 2500/02* (2013.01)

(58) Field of Classification Search

CPC .... F25D 23/069; F25D 25/005; F25D 25/025; F25D 11/02; F25D 17/042
USPC ..... 312/401, 402, 404, 408
See application file for complete search history.

(56) References Cited

U.S. PATENT DOCUMENTS 1,249,785 A 12/1917 Layman
1,688,887 A 10/1928 Spreen
(Continued)

FOREIGN PATENT DOCUMENTS

DE 10 2007 021 555 A1 11/2008
EP 2 752 632 A2 7/2014
(Continued)

*Primary Examiner* — James O Hansen
(74) *Attorney, Agent, or Firm* — Nixon & Vanderhye P.C.

(57) ABSTRACT

A domestic refrigeration appliance with a housing in which a receiving chamber for foodstuffs is formed, is delimited by walls of an interior container, and is formed with an additional compartment for foodstuffs in the receiving chamber comprising delimiting walls by way of which a receiving volume of the additional compartment is delimited. Delimiting walls can be separated and joined non-destructively, thus enabling the additional compartment to be reversibly assembled and disassembled in the receiving chamber.

18 Claims, 7 Drawing Sheets

(51) Int. Cl.

| | |
|---|---|
| ***F25D 25/02*** | (2006.01) |
| ***F25D 23/08*** | (2006.01) |
| *F25D 25/04* | (2006.01) |

(56) References Cited

U.S. PATENT DOCUMENTS

| | | | | |
|---|---|---|---|---|
| 3,079,028 | A | 2/1963 | Rosner | |
| 4,317,607 | A * | 3/1982 | Gomolka | F25D 13/04 312/236 |
| 2011/0259036 | A1* | 10/2011 | Lim | F25C 1/24 62/344 |
| 2012/0146477 | A1* | 6/2012 | Bischofberger | F25D 25/025 312/404 |
| 2015/0059398 | A1* | 3/2015 | Yoo | B65D 25/2802 62/407 |

FOREIGN PATENT DOCUMENTS

| | | | |
|---|---|---|---|
| JP | 3-91681 | A | 4/1991 |
| WO | WO 02/090849 | A1 | 11/2002 |

* cited by examiner

DOMESTIC REFRIGERATION APPLIANCE WITH AN INDIVIDUALLY CREATABLE ADDITIONAL COMPARTMENT AND METHOD FOR THE FORMATION OF AN ADDITIONAL COMPARTMENT

This application claims priority to DE Patent Application No. 102015221440.0 filed Nov. 2, 2015 and DE Patent Application No. 102016220444.0 filed Oct. 19, 2016, the entire contents of each of which are hereby incorporated by reference.

The invention relates to a domestic refrigeration appliance with a housing in which a receiving chamber for foodstuffs is formed. The receiving chamber is delimited by walls of an interior container. Formed in the receiving chamber is an additional compartment for foodstuffs comprising delimiting walls by means of which a receiving volume of the additional compartment is delimited. The invention also relates to a method for the formation of an additional compartment of this kind.

With household refrigeration appliances for storing foodstuffs, such as, for example, a fridge or a freezer or combined fridge-freezer, it is known that the corresponding receiving chamber, which can be a cooling compartment or a freezing compartment, can be divided by insertable horizontal plates, which can be compartment bottoms. It is then possible to place foodstuffs on these compartment bottoms. However, compartment bottoms of this kind do not form an individual, per se delimited additional compartment in the receiving chamber, instead the actual receiving chamber is divided into partial regions that are still interconnected and not completely separated from one another.

Also known is the embodiment of a per se separate additional compartment in a receiving chamber of this kind, which can, for example, be a keep-fresh compartment. This specific additional compartment is delimited by walls so that the receiving volume of this additional compartment is defined per se and closed. However, with known embodiments of additional compartments of this kind, said compartments are prespecified and formed in the receiving chamber.

It is the object of the present invention to provide a domestic refrigeration appliance and a method in which or with which an additional compartment of this kind can be provided in accordance with requirements.

This object is achieved by a domestic refrigeration appliance and a method as claimed in the independent claims.

A domestic refrigeration appliance according to the invention comprises a housing in which a receiving chamber for foodstuffs is formed. This receiving chamber is delimited by walls of an interior container. An additional compartment for foodstuffs comprising delimiting walls or outer walls is formed in the receiving chamber. A receiving volume of the additional compartment is delimited by these delimiting walls and is hence delimited by at least one delimiting wall on all the sides determining the geometry of the additional compartment. This receiving volume of the additional compartment is hence in particular delimited on all sides and hence also completely delimited from the remaining volume of the receiving chamber.

An essential concept of the invention can be seen in that these delimiting walls of the additional compartment can be separated and joined non-destructively thus enabling the additional compartment to be assembled and disassembled reversibly in the receiving chamber. This embodiment substantially increases the usability of the additional compartment and hence also renders it more flexible and variable.

This possibility of simple dismantling possibly followed by re-assembly increases the usability of the additional compartment. When not required, it can be disassembled simply and quickly thus enabling the space that is then freed up in the receiving chamber to be used for other purposes. However, when required, the additional compartment can be quickly assembled and form a per se in particular completely enclosed receiving volume defined by the delimiting walls. This also increases the usability of the entire domestic refrigeration appliance and the receiving chamber can be flexible and user-specific.

The number of delimiting walls comprised by the additional compartment is such that, regardless of its geometry, each side of this geometry is at least one delimiting wall and hence the additional compartment is formed with at least one delimiting wall on each of these sides of the geometry and hence the receiving volume is correspondingly delimited.

The additional compartment is arranged separately to a door, which closes the receiving chamber, in the receiving chamber. Therefore, the additional part is not arranged on the door.

In one preferred embodiment, it is provided that the additional compartment is a keep-fresh compartment in which an atmospheric humidity different to that in the receiving chamber and/or a temperature different to that in the receiving chamber can be set selectively. Hence, an embodiment of this kind can provide an individual zone in the receiving chamber in which storage conditions for foodstuffs different to those in the remaining volume of the receiving chamber can be set. This enables different foodstuffs to be stored in accordance with requirements and hence their individual storage life and freshness to be maintained for longer.

In one particularly advantageous embodiment, it is provided that the additional compartment can be assembled at a first defined position in the receiving chamber or at at least one further second defined position different from the first position in the receiving chamber. Such positional flexibility is advantageous with respect to ease of access to the additional compartment and to then remaining partial volume of the receiving chamber. This enables users to satisfy their requirements and to individualize the positional embodiment of the additional compartment. This may possibly also achieve ergonomic advantages with respect to ease of access and hence to the stocking of the additional compartment and also with respect to the removal of foodstuffs therefrom. Moreover, this embodiment also enables the additional compartment to be assembled at different positions depending on the situation in question. Then, either the first position or the second position may be more advantageous for the additional compartment in dependence on the foodstuffs that are to be stored in the remaining volume of the receiving chamber and, for example, in dependence on the quantity and/or size of these foodstuffs. Hence, a user is able to react with utmost flexibility even in these individual situations. In practice, this has substantial advantages over embodiments with which the manufacturer specifies an additional compartment in one single fixed position in the receiving chamber and the position of this additional compartment cannot be changed.

It can also be provided that, in its assembled state and hence in the state arranged in the receiving chamber, the additional compartment can be moved from the first position into the second position, in particular can be pushed as a whole, and/or moved from the second position into the first position. With an embodiment of this kind, there is then no need for a dismantling process or disassembly process for the additional compartment followed by assembly at a different position, instead a selective change to the position of the additional compartment can be performed simply and quickly.

In this case, it can in particular be provided that mechanical coupling means are present on the inner sides of the interior container and/or on delimiting walls of the additional compartment to enable a positional change of this kind, in particular a displacement. For example, these can be runners that engage in corresponding recesses or grooves.

With delimiting walls of the additional compartment, it can generally be provided that these walls comprise coupling means so that the delimiting walls can be connected mechanically to one another, wherein these coupling means can be detached non-destructively. In this context, it is possible for plug-in connections or latching connections to be provided. Alternatively, it is also possible for other connecting means to be provided. At specific points, it can also be provided that delimiting walls of the additional compartment only directly abut one another, for example abut one another via a sealing element, so that then no specific mechanical connecting means are provided in this case.

Advantageously, it is provided that the position at which the additional compartment can be assembled in the receiving chamber can be selected in dependence on which wall of the interior container is to embody which locally specific delimiting wall of the additional compartment. It is provided that the additional compartment is not exclusively assembled from separate delimiting walls, but, for example, at least one delimiting wall is formed by a wall of the interior container and in dependence thereon the position of the additional compartment in the receiving chamber is preferably such that this wall of the interior container also provides the envisaged delimiting wall of the additional compartment. An embodiment of this kind can then enable at least one separate delimiting wall of the additional compartment to be dispensed with and hence the overall number of components of the domestic refrigeration appliance can be reduced.

It is preferably provided that the position of the additional compartment in the receiving chamber is arranged above the second position in the height-wise direction of the domestic refrigeration appliance. As a result, the additional compartment can be formed further up or further down in the vertical direction thus, depending on the position of the domestic refrigeration appliance, if necessary this also enables an advantageous height to be established individually for a user of the additional compartment. If, for example, the domestic refrigeration appliance is a free-standing appliance and hence stands on the floor, another individual height position of the additional compartment can be advantageous for a user compared to when the domestic refrigeration appliance is a built-in appliance and has to be installed at a certain height in an installation niche. In order also to be able to take account of these requirements and circumstances on a highly individual basis, this possibility of assembly at at least two different positions in the additional compartment is particularly advantageous.

It is preferably provided that the additional compartment comprises as separate delimiting walls a front wall, a bottom wall, a top wall, a rear wall and side walls. With this embodiment, the additional compartment is hence in particular parallel epipedal or cuboid in shape.

It is in particular provided that the additional compartment comprises at least one further separate delimiting wall, which is arranged in the receiving volume. This further separate delimiting wall is in particular a partition wall with which the receiving volume of the additional compartment can be separated into at least two partial volumes. This again enables the additional compartment itself to be configured individually and hence functionality to be increased. The then at least two individually configurable partial volumes then in turn also enable individual storage conditions to be set for foodstuffs to be inserted therein. Advantageously, this partition wall can be inserted in and removed again from the receiving volume in a non-destructively detachable manner so that, in this case, once again very high flexibility is achieved with respect to the embodiment in the interior.

It is advantageously provided that the partition wall is a thermal insulation wall. This has the result that the partial volumes can be thermally insulated from one another so that it is once again possible to set the different storage conditions in the partial volume without the respective other partial volume being influenced in an undesirable way.

In this context, it is then also possible to enable different temperatures and/or different atmospheric humidity values to be set in the partial volume.

It is preferably provided that the partition wall comprises at least one flow duct with which cold air can be guided from outside of the additional compartment into the receiving volume of the additional compartment. This enables particularly advantageous storage conditions to be set with cool temperatures, preferably above freezing point, which is particularly advantageous for fruit and vegetables, and also, for example for fish, and maintains the storage life of these foodstuffs and the freshness of these foodstuffs for longer.

It is in particular provided that the additional compartment comprises as a separate delimiting wall a frame with a feed-through opening with said frame forming a front wall of the additional compartment. This is a further very advantageous embodiment since this also enables further components to be introduced into the additional compartment, for example a drawer, which is able to receive foodstuffs. This drawer can then be simply pushed over the frame formed as a front wall and hence extends through the feed-through opening into the receiving volume of the additional compartment. It is then in particular provided that, in completely pushed-in state, a drawer of this kind or a corresponding container abuts the frame and in this respect the feed-through opening is then covered by the drawer, in particular a front wall of the drawer. With an embodiment of this kind, then in particular a completely enclosed receiving volume of the additional compartment is also provided.

It is advantageously provided that the frame comprises at least two separate feed-through openings. This is then particularly advantageous if a partition wall, as mentioned above, is also present. Individual separate drawers or containers can then be introduced into the respective partial volumes of the receiving volumes of the additional compartment through the respective feed-through openings. This enables two drawers to be arranged next to one another and preferably at the same height when viewed in the width-wise direction of the domestic refrigeration appliance. They are then very easy to access and stocking and removal are possible in a very user-friendly manner.

It is preferably provided that the additional compartment comprises at least one receiving drawer for foodstuffs, which is arranged so that it can be pushed in and pulled out of the receiving volume formed by the delimiting walls through the feed-through opening. This enables foodstuffs to be inserted and removed from the additional compartment in a particularly simple manner. It is not necessary to remove any of the delimiting walls completely in order to access the receiving volume. The simple and user-friendly movement of only the receiving drawer enables the removal of the foodstuffs contained in the receiving drawer or the introduction of corresponding foodstuffs into the receiving drawer in a very simple manner.

It is in particular provided that a sealing element surrounding a feed-through opening is arranged on a front side of the frame on which the receiving drawer lies in pushed-in state. This is a further advantageous embodiment, since this means that, not only are the feed-through openings covered on the front side by a front wall of the receiving drawer in pushed-in state, but also unwanted escape of atmospheric humidity is prevented in this case. On the other hand, it is also possible to reduce any temperature alignment between the in particular colder receiving volume of the additional compartment and the remaining partial volume of the receiving chamber at least to a significant extent.

Advantageously, the frame is pushed into separate holding rods on opposite sides. As a result, the frame is accurately positioned and held in a stable manner. This results in reversible attachment and removal once again in a particularly simple manner and, even with frequent mounting and dismantling of the frame, wear is avoided so that, even with frequent mounting and dismantling, wobble-free seating of the frame on the holding rods is enabled. Moreover, this method of attaching the frame enables very quick mounting and dismantling, which is also very simple to perform.

It is preferably provided that a delimiting wall is a wall of the interior container or a compartment floor, which is arranged in the receiving chamber so that it can be non-destructively detached and divides the receiving chamber.

A further aspect of the invention relates to a domestic refrigeration appliance with a housing in which a receiving chamber for foodstuffs is formed, wherein this receiving chamber is delimited by walls of an interior container. Formed in the receiving chamber, is an additional compartment for foodstuffs comprising delimiting walls by means of which a receiving volume of the additional compartment is delimited. In particular, with this aspect it is provided that the additional compartment can be assembled at a defined first position in the receiving chamber or at at least one further second defined position in the receiving chamber. The advantages achievable thereby were already mentioned above. It can in particular be provided that in each case fastening means for one or more delimiting walls of the additional compartment are provided on walls of the interior container for these two defined positions.

Embodiments of the first aspect of the invention should be considered to be advantageous embodiments of this further aspect of the invention.

A further independent aspect of the invention relates to a domestic refrigeration appliance with a housing in which a receiving chamber for foodstuffs delimited by walls of an interior container is formed. Formed in the receiving chamber is an additional compartment for foodstuffs comprising delimiting walls by means of which a receiving volume of the additional compartment is delimited. An essential concept of this aspect of the invention can be seen in that the additional compartment comprises at least one further separate delimiting wall, which is a partition wall with which the receiving volume of the additional compartment can be separated into at least two partial volumes. The partition wall can be formed as one piece or multiple pieces.

This enables individual zones to be formed in the additional compartment in which different storage conditions for foodstuffs can be set.

The invention also relates to a method for the embodiment of an additional compartment for receiving foodstuffs in a receiving chamber for foodstuffs of a domestic refrigeration appliance. With the method, separate delimiting walls from which the additional compartment are assembled are provided and the delimiting walls are arranged in the receiving chamber such that a receiving volume of the additional compartment is formed. Therefore, the receiving volume is delimited on all geometric sides by a delimiting wall at least in regions. The receiving volume is in particular completely delimited by the delimiting walls on the periphery. The delimiting walls are connected so that they can be non-destructively detached so that the additional compartment can be reversibly dismantled again and re-assembled. The advantages achievable thereby were also cited above in the depiction of the different aspects of the domestic refrigeration appliance.

In particular, a first defined installation position is specified in the receiving chamber at which the additional compartment can be assembled in a modular manner and at least one second defined installation position different from the first position is specified at which the additional compartment can be assembled in a modular manner.

Therefore, the additional compartment with its delimiting walls is provided so-to-speak as an assembly kit that can be installed at different positions in the receiving chamber.

Therefore, it is in principle also possible to offer the additional compartment as an add-on kit so that users of a domestic refrigeration appliance can procure this add-on kit at a later date if they require an additional compartment of this kind.

The additional compartment is formed as a keep-fresh compartment in which a different temperature and/or a different atmospheric humidity compared to the remaining volume of the receiving chamber can be set or is set. To this end, the domestic refrigeration appliance in particular comprises an adjusting apparatus.

The additional compartment can comprise one or more air ducts with which cold and/or moist air can be introduced into the additional compartment.

It is in particular provided that the additional compartment is arranged in a receiving chamber of the domestic refrigeration appliance formed as a chiller compartment such that it can be reversibly assembled and disassembled again in a non-destructive manner. In particular, in this receiving chamber formed as a chiller compartment, the domestic refrigeration appliance comprises at least one further receiving chamber which is in particular formed as a freezer compartment. Viewed in the vertical direction, and hence in the height-wise direction of the domestic refrigeration appliance, the chiller compartment is preferably formed above the chiller compartment. The chiller compartment can be closed by one single door, but can also be closed by two pivotable doors arranged next to one another. The freezer compartment can be closed by a further door separate thereto, wherein the doors represent front components of the domestic refrigeration appliance and in closed state extend particularly preferably in one plane.

It can be provided that a delimiting wall of the additional compartment representing a floor of the additional compartment is formed by a floor of the interior container. This can be provided in a specific first position or a corresponding first installation position of the additional compartment in the receiving chamber. If namely, the additional compartment is formed so-to-speak right at the bottom in the receiving chamber in the height-wise direction, it is advantageous for a wall of the interior container of this kind which is already present, namely the floor, also to be used as the floor for the additional compartment.

Correspondingly, when another installation position different thereto is provided in the upper region of the receiving chamber, it can then be provided that a roof of the interior container is used as the top wall of the additional compartment.

If on the other hand, an installation position of the additional compartment is provided at a distance from the roof and the floor of the interior container, it is, for example, possible for a wall that is otherwise used as a the compartment floor that can be inserted in the height-wise direction in the receiving chamber between the roof and the floor of the interior container to be used as a roof of the additional compartment. With an embodiment of this kind, it is then, on the one hand, possible for the additional compartment to be upper-delimited by this separate delimiting wall, on the other hand, it is also possible for another storage material to be placed thereupon.

If a chiller compartment and a freezer compartment are formed in one single interior container and separated from one another by a thermally insulated partition wall, this thermally insulated partition wall of the interior container can also be a top wall or a bottom wall of the additional compartment.

In one embodiment of the invention, the additional compartment extends over the entire width of the receiving chamber. However, it can also be provided that this additional compartment only extends over a partial width of the receiving chamber, for example over a half, a third, or three-quarters of this width of the receiving chamber. This width of the receiving chamber extends between the opposite vertical side walls of the interior container. It can be provided that the above-cited embodiment with which the additional compartment comprises a partition wall as a further separate delimiting wall with which the receiving volume of the additional compartment can be divided into at least two separate partial volumes comprises a plurality of air ducts which, on the one hand, feed into the first partial volume and, on the other hand, into the second partial volume.

The terms "up", "down", "front", "rear, "horizontal", "vertical", "depth-wise direction", "width-wise direction", "height-wise direction" refer to the positions and orientation with use as specified and the arrangement as specified of the appliance and with a observer standing in particular in front of the appliance looking in the direction of the appliance.

Further features of the invention are apparent from the claims, the figures and the description of the figures. The features and feature combinations cited above in the description and the features and feature combinations mentioned below in the description of the figures and/or shown in the figures alone are usable not only in the respectively specified combination, but also in other combinations without leaving the scope of invention. Hence, embodiments of the invention that are not explicitly shown and explained in the figures but are derived from separated feature combinations from the embodiments explained and may be generated thereby should also be considered as being comprised and disclosed by the invention. Hence, embodiments and feature combinations which do not comprise all the features of an originally worded independent claim should also be considered to be disclosed. Moreover, embodiments and feature combinations, in particular in the above-described embodiments, which extend beyond or deviate from the feature combinations described in the back-references in the claims should also be considered to be disclosed.

Exemplary embodiments of the invention are described below with reference to schematic drawings, which show:

FIG. 1 a perspective view of an exemplary embodiment of a domestic refrigeration appliance according to the invention;

FIG. 2 a magnified view of a partial region of the domestic refrigeration appliance as shown in FIG. 1;

FIG. 3 a sectional view through the domestic refrigeration appliance as shown in FIG. 1;

FIG. 4 a perspective view of the exemplary embodiment of an additional compartment of the domestic refrigeration appliance;

FIG. 5 a side view of the additional compartment shown in FIG. 4;

FIG. 6 a perspective view from behind of the additional compartment shown in FIG. 4 and FIG. 5;

FIG. 7 a perspective view of a delimiting wall of an additional compartment formed as a frame of an additional compartment with holding rods on which the frame is arranged in the end position;

FIG. 8 the view of the frame shown in FIG. 7 with the additional holding rods on which the frame can be fastened;

FIG. 9 a front view of a partial region of the domestic refrigeration appliance as shown in FIG. 1, wherein in this case the frame shown in FIG. 7 and FIG. 8 is partially pushed onto the holding rods as shown in FIG. 8;

FIG. 10 a view of the domestic refrigeration appliance with the components shown in FIG. 7, wherein in this perspective the frame is arranged in its end position provided with the holding rods;

FIG. 11 a simplified vertical sectional view through a domestic refrigeration appliance as shown in FIG. 1 in which the additional compartment is installed at a first position;

FIG. 12 a vertical sectional view of FIG. 11, wherein in this case the additional compartment is assembled in the receiving chamber in a second position different from that in FIG. 11; and FIG. 13 an exploded view of an exemplary embodiment of a partition wall, which can be arranged in the additional compartment.

In the figures, the same elements or elements with the same functions are given the same reference numbers.

FIG. 1 is a perspective view of an exemplary embodiment of a domestic refrigeration appliance 1. The domestic refrigeration appliance 1, which is intended to store and preserve foodstuffs, comprises a housing 2. Formed in the housing 2 is a first receiving chamber for foodstuffs, which in the exemplary embodiment is a chiller compartment 3. At least one further receiving chamber, which is a freezer compartment 4, is formed in the housing 2. The freezer compartment 4 can be closed by a separate door 5, which in FIG. 1 is shown in closed state. The door 5 can be a front wall of a drawer which can be pushed into and pulled out of the freezer compartment 4.

The chiller compartment 3 can be closed at the front side by one single door arranged in a pivotable manner on the housing 2. In the exemplary embodiment, it is provided that the chiller compartment 3 can be closed by a door 6 and a further door 7 at the front side. The two separate doors 6 and 7 can each be pivoted about a pivot axis in the height-wise direction (y-direction).

In the chiller compartment 3, compartment bottoms 8 and 9, the number, position and embodiment of which should only be understood as being exemplary, are arranged at different heights and hence at different levels. They are in particular arranged on internal sides of opposite walls 10 and 11 (FIG. 2), but can additionally also be arranged on a rear wall 12. The walls 10 and 11, which represent vertical side walls, the rear wall 12 and a top wall 13 and a bottom wall 14 represent walls of an interior container 15. The walls 10 to 14 also delimit the chiller compartment 3, wherein the bottom wall 14 of the chiller compartment 3 is also a partition wall between the chiller compartment 3 and the freezer compartment arranged thereunder.

In the exemplary embodiment, an additional compartment 16 is also formed in the chiller compartment 3. The additional compartment 16 is intended to receive foodstuffs. It comprises several separate delimiting walls, by means of which a receiving volume 17 (FIG. 2) is delimited. In particular, the receiving volume 17 is delimited on all sides by delimiting walls of the additional compartment 16 so that this is a completely closed chamber.

The delimiting walls of the additional compartment 16 are formed so that they can be non-destructively detached and so that they can be separated and joined non-destructively. As a result, the additional compartment 16 can be reversibly assembled and dissembled again in the receiving chamber and hence in the chiller compartment 3.

The modular design of this additional compartment 16 hence enables this additional compartment 16 to be created in the chiller compartment 3 for an individual user but also to be dismantled again.

Hence this additional compartment 16 can be present or not present as required and hence then used for its intended function in the chiller compartment 3 or, if it is not required, disassembled.

The additional compartment 16 is in particular a keep-fresh compartment in which an atmospheric humidity different from the remaining volume of the chiller compartment 3 and/or a temperature different to that in the remaining volume of the chiller compartment 3 can be set selectively. To this end, the domestic refrigeration appliance 1 comprises an adjusting apparatus as is explained below.

FIG. 1 shows the additional compartment 16 in assembled state and moreover assembled at a first defined position provided by way of example in the chiller compartment 3. In this case, the additional compartment 16 is assembled in the lower region of the chiller compartment 3.

In this case, the additional compartment 16 comprises as a separate delimiting wall a top wall 18, as shown in FIG. 2. FIG. 2 shows a partial segment of the interior container 15 of the domestic refrigeration appliance 1. This top wall 18 represents a separate component, which can be removed from the chiller compartment 3 and re-inserted therein again. It can also be a compartment floor on which additionally further goods to be stored can then be placed from above. In the exemplary embodiment, this top wall 18 then also represents a partition wall with a further, self-enclosed storage chamber 19 (FIG. 1), which is also formed in the chiller compartment 3.

As can also be identified in FIG. 2, the additional compartment 16 also comprises a separate front wall 20 as a further delimiting wall. In the embodiment shown, this front wall 20 is a frame 21 comprising at least one, in the exemplary embodiment two, feed-through openings 22 and 23. Viewed in the depth-wise direction (z-direction) of the domestic refrigeration appliance 1, the frame 21 is arranged offset toward the front at a distance from rear wall 12. In the exemplary embodiment, the additional compartment 16 extends over the entire width of the chiller compartment 3, wherein this width is dimensioned in the width-wise direction and hence in x-direction of the domestic refrigeration appliance 1. It is also possible for an additional compartment 16 to be provided which has a narrower width in this respect.

Moreover, a further delimiting wall of the additional compartment 16 is formed by the side wall 10 and a further delimiting wall by the side wall 11 of the interior container 15. In the embodiment shown, moreover a delimiting wall of the additional compartment 16 is also formed by the floor 14 of the interior container 15.

To attach the separate delimiting walls in the form of the top wall 18 and the front wall 20 to the interior container 15, local fastening means are provided on the interior container 15 and/or the top wall 18 and/or the front wall 20.

In particular, this defined locally arranged fastening means then also specifies a defined first installation position of the additional compartment 16 in the chiller compartment 3.

Receiving drawers 24 and 25, as shown in FIG. 1, can be pushed through the feed-through openings 22 and 23 so that they are then at least partially arranged in the receiving volume 17. As can be identified in FIG. 1, in pushed-in state of the receiving drawers 24 and 25, front walls 24*a* and 25*a* of the receiving drawers 24 and 25 are also front walls that completely cover the feed-through openings 22 and 23 at the front side. It is in particular provided that a first sealing element 26, in particular completely surrounding the feed-through opening 25, is arranged on a front side 20*a* of the front wall 20. A further sealing element 26 surrounding, in particular completely surrounding, the further feed-through opening 23 is arranged at this front side 20*a*. In closed state of the receiving drawers 24 and 25, the front walls 24*a* and 25*a* then lie on the rear side of these sealing elements 26 and 27 so that in this case a corresponding sealing effect is also achieved.

It can also be provided that at least one receiving drawer 24 and/or 25 comprises a lid 28 (FIG. 3) or a lid 29 (FIG. 4) with which the receiving drawers 24 and 25 are covered from above. It is also possible to adjust the position of the lids 28 and 29 relative to the receiving drawers 24 and 25. As a result, it is possible for the receiving drawer 24 or 25 to be completely covered from above or for a specific opening gap to be set between a lid 28, 29 and a receiving drawer 24, 25 by a stepwise-enabled elevation of the lid 28, 29. As a result, the temperature and/or atmospheric humidity prevailing in the interior of the receiving drawer 24 or 25 can be individually changed.

FIG. 3 is a sectional view along the line of intersection in FIG. 1.

FIG. 4 is a perspective front view of partial components of the additional compartment 16. In this case, the receiving drawers 24 and 25 are depicted. The top wall 18 and the front wall 20 are also identifiable as the frame 21.

This view also shows a further separate delimiting wall of the additional compartment 16, wherein this further separate delimiting wall represents a partition wall 30. This partition wall 30 is arranged in the receiving volume 17 of the additional compartment 16 such that, as can already be identified in FIG. 2, this receiving volume 17 is divided into two partial volumes 17*a* and 17*b*. The partition wall 30 is preferably a thermally insulated wall so that the two partial volumes 17*a* and 17*b* can also be thermally insulated from one another. As a result, once again different storage conditions can be set in this partial volume 17*a* and 17*b* independently of one another.

Figure 6:
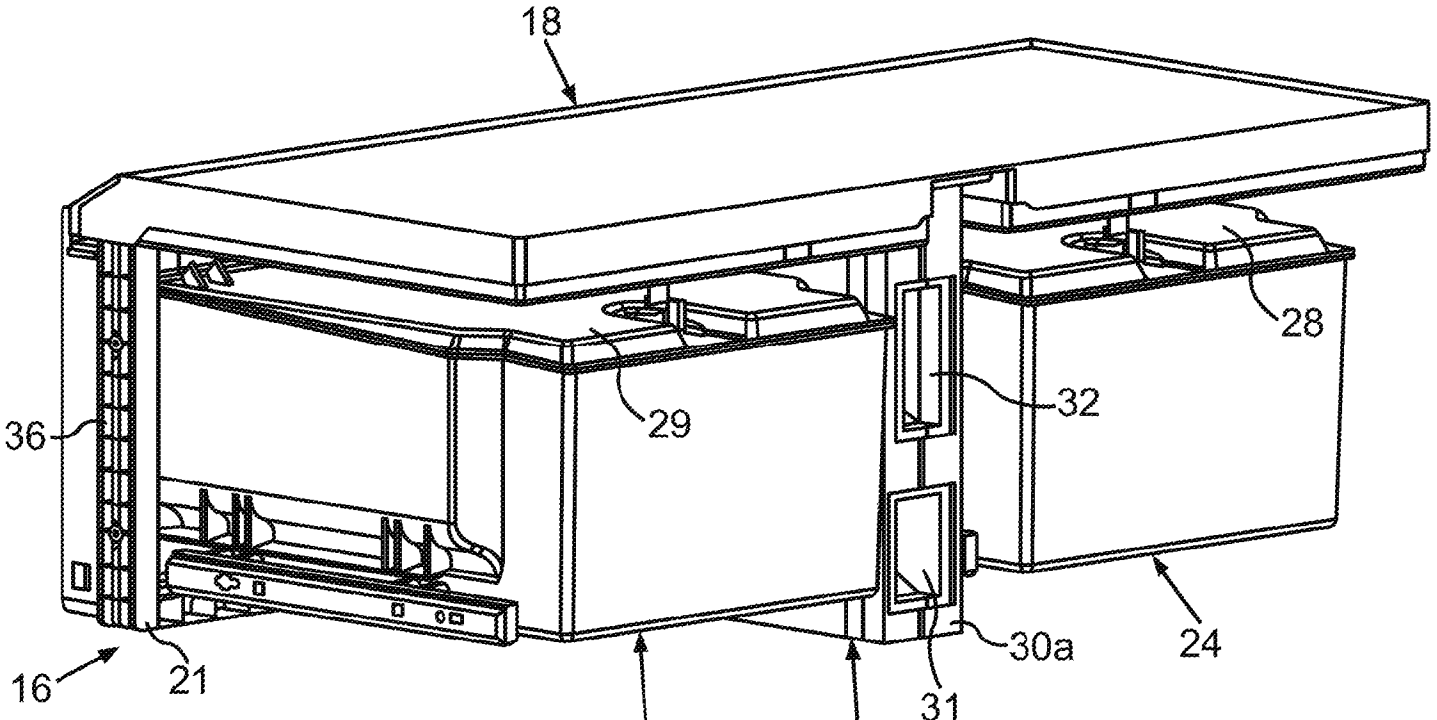
FIG. 6 is a perspective view of the components of the additional compartment 16 from behind as depicted in FIG. 4 and FIG. 5 from other perspectives or views.

Formed in the partition wall 30, are in particular one or more air ducts, wherein the air ducts feed into a rear edge 30*a*. FIG. 6 shows a feed from a first air duct 31 and a feed from a second air duct 32. The air ducts 31 and 32 respectively feed into one of the partial volumes 17*a* and 17*b*, wherein for example the air duct 31 is able to feed into the partial volume 17*b* and the air duct 32 into the partial volume 17*a*. In particular, the partition wall 30 and the two air ducts 31 and 32 can be coupled to a further air duct system in the domestic refrigeration appliance 1 so that cold air and/or air provided with a specific moisture content can be introduced individually into the partial volumes 17*a* and 17*b*.

This partition wall 30 can be formed in one piece but can also be assembled as a multi-piece component. Further explanations of this will be given in the following.

Figure 7:
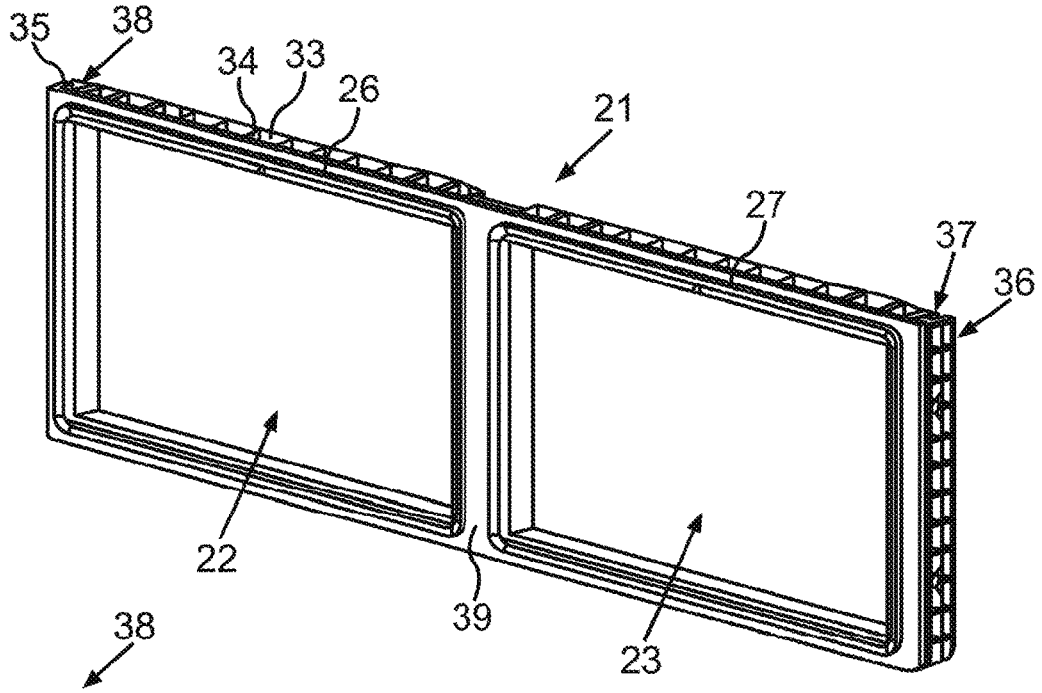

FIG. 7 is a perspective view of the frame 21. As can be identified in this case, at least in some regions, the frame 21 has a panel-type structure and hence, at least in some regions, has a type of reinforcing structure 33 in which a plurality of struts 34 are arranged, wherein in this case, for purposes of clarity, the reference number 34 only shows one strut.

The frame 21 is in particular formed in one piece, in particular made of plastic.

Figure 8:
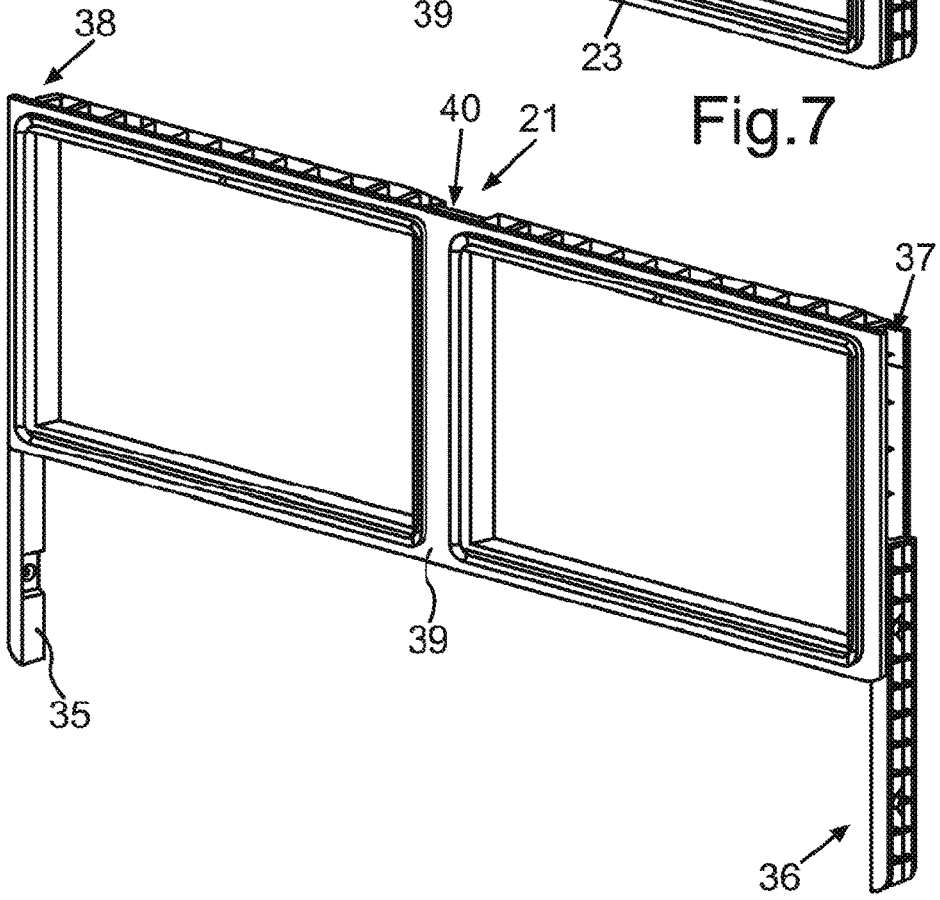

FIG. 8 shows how the frame 21 can be mounted on two separate holding rods 35 and 36. These linear holding rods 35 and 36 can preferably be attached, in particular screwed-on, at defined positions on the interior container 15, in particular on internal sides of the vertical side walls 10 and 11. To this end, preferably defined connecting points, in particular screw domes, can be specified at fixed points on these vertical side walls 10 and 11. As a result, different positions are then also specified for the holding rods 35 and 36 so that, at least viewed in the height-wise direction of the domestic refrigeration appliance 1, these holding rods 35 and 36 can be fastened at at least two different heights and hence at two different positions. As a result, then in particular two different positions or installation positions for the additional compartment 16 are also specified in this height-wise direction.

It can additionally or alternatively be provided that, in the depth-wise direction (z-direction) of the domestic refrigeration appliance 1, at least two different depths are specified at which the holding rods 35 and 36 can be fastened, in particular screwed-on. This embodiment enables both dimensions of the additional compartment 16 to be set in the depth-wise direction and the general position in the height-wise direction to be selected.

In FIG. 8 it can also be identified that the frame 21 comprises on opposite sides, in particular vertical sides, grooves as receptacles 37 and 38 in which the holding rods 35 and 36 engage. When the holding rods 35 and 36 are fastened in their desired positions to the side walls 10 and 11, the frame 21 can be pushed onto them. In this case, FIG. 8 shows a partially pushed-on interim assembly state, while FIG. 7 shows the completely pushed-on final state of the frame 21 on the holding rods 35 and 36.

Figure 1:
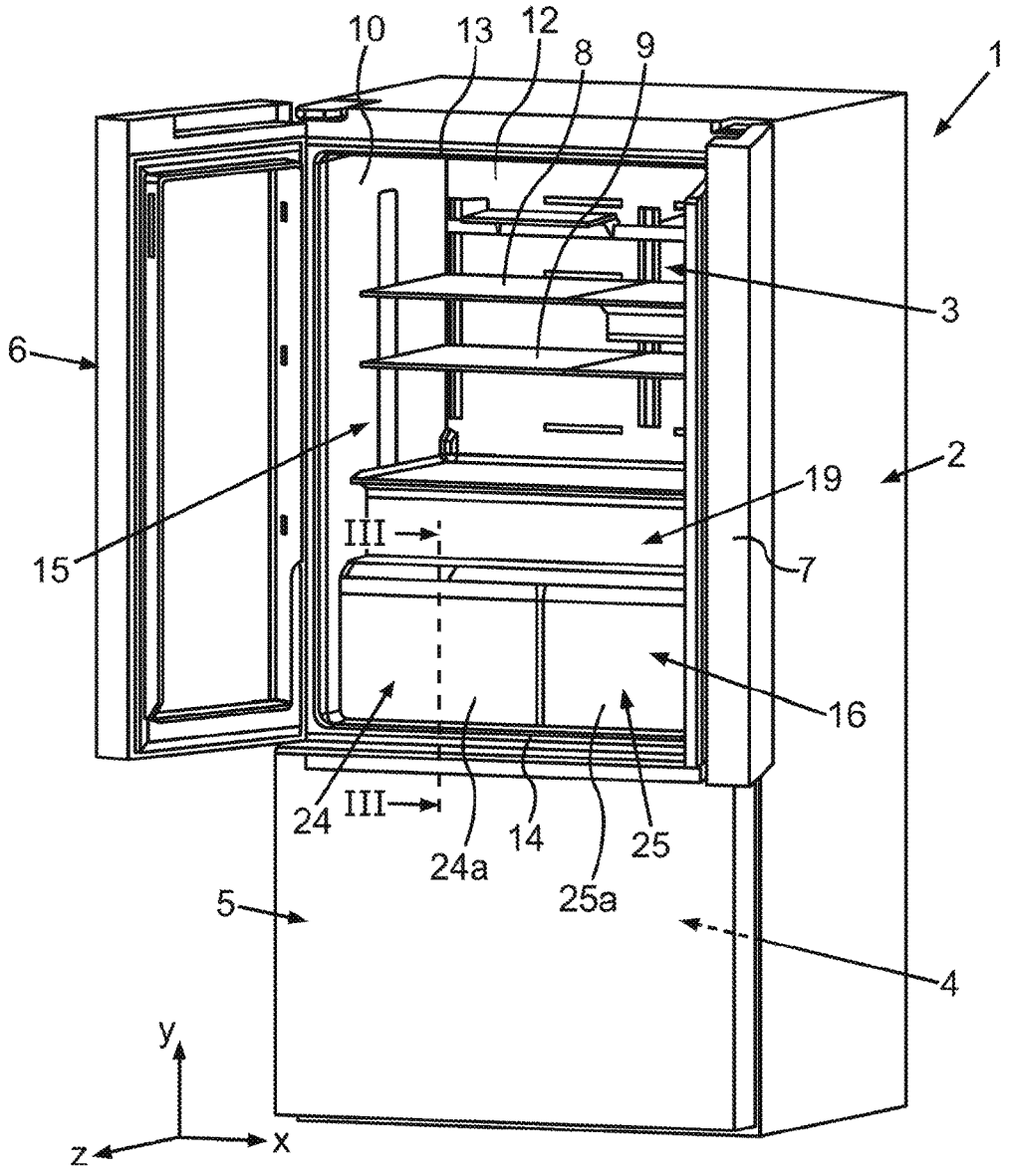
Figure 2:
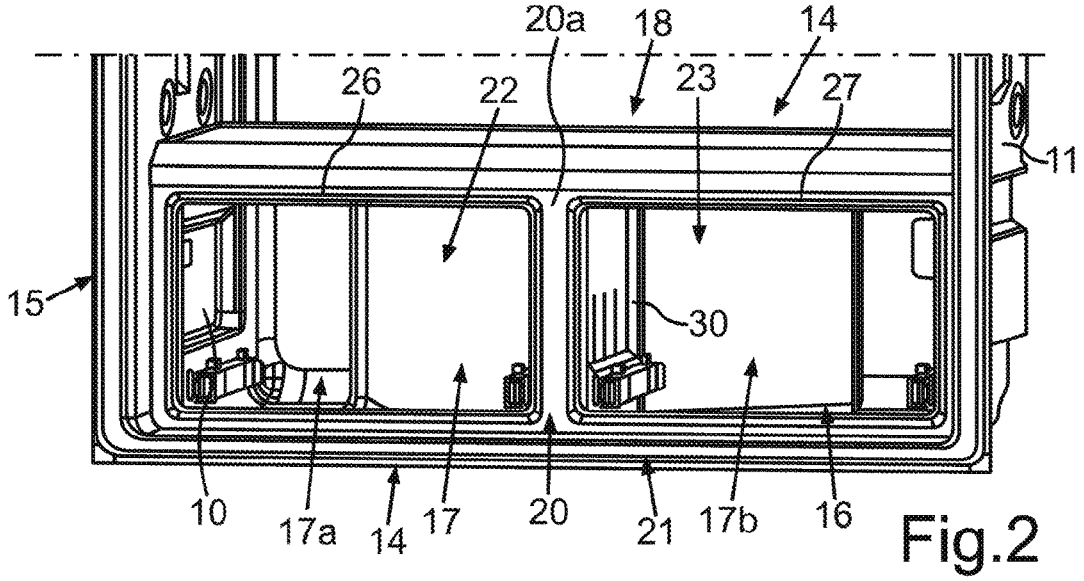
Figure 3:
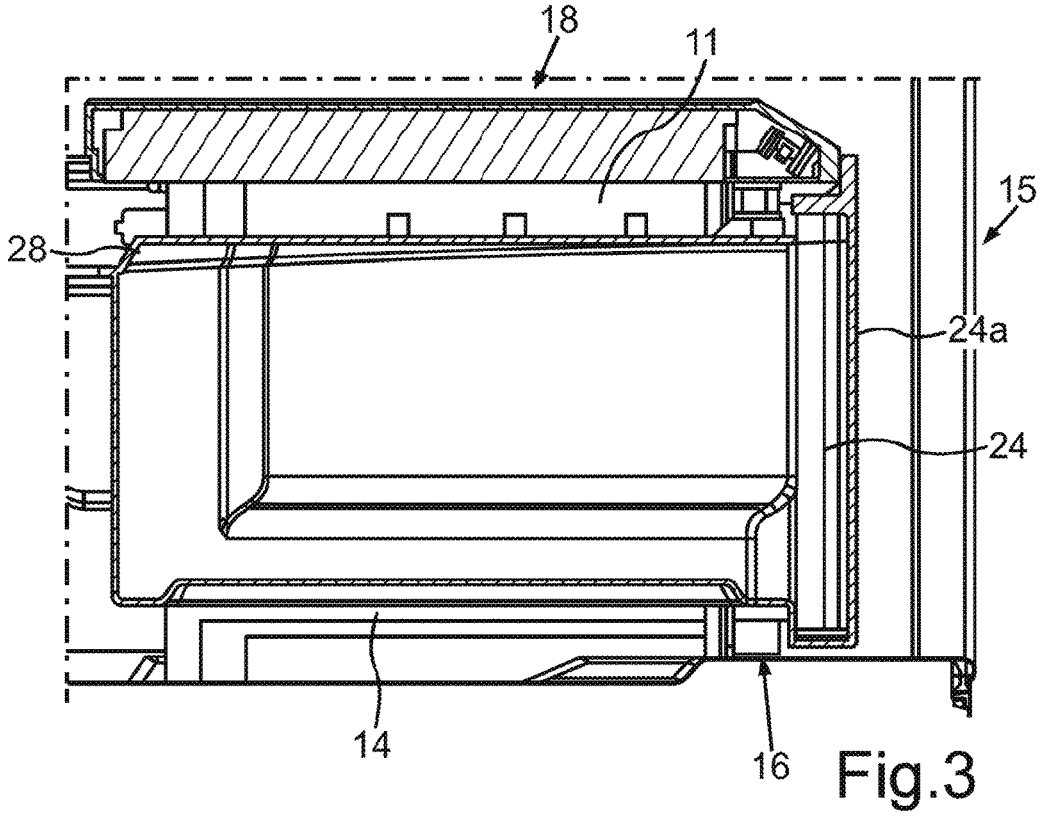
Figure 4:
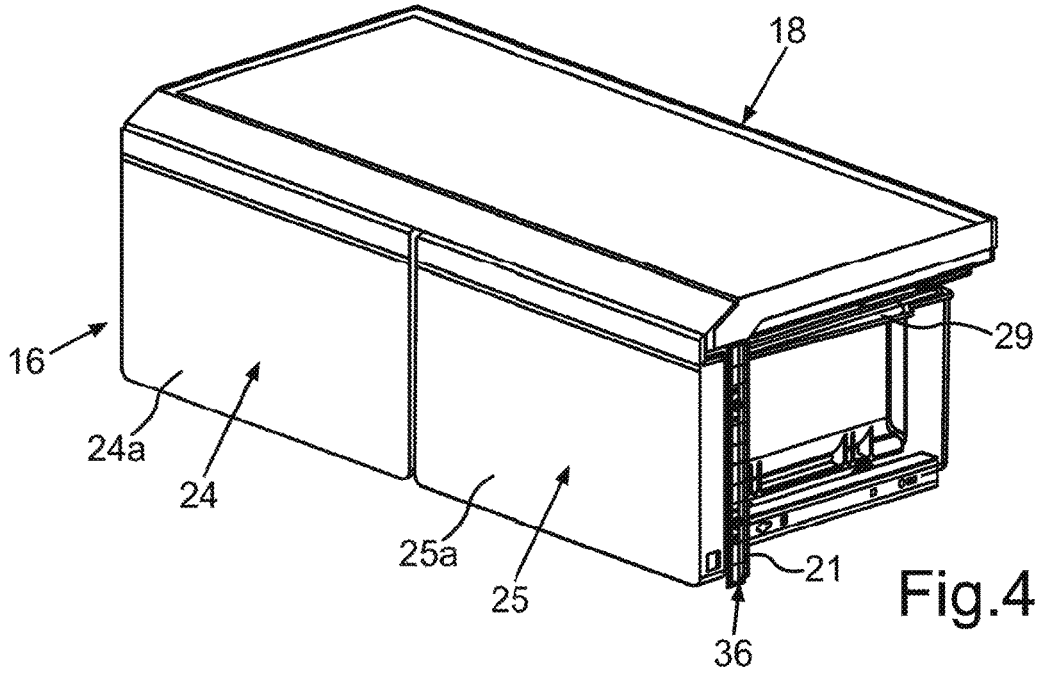
Figure 5:
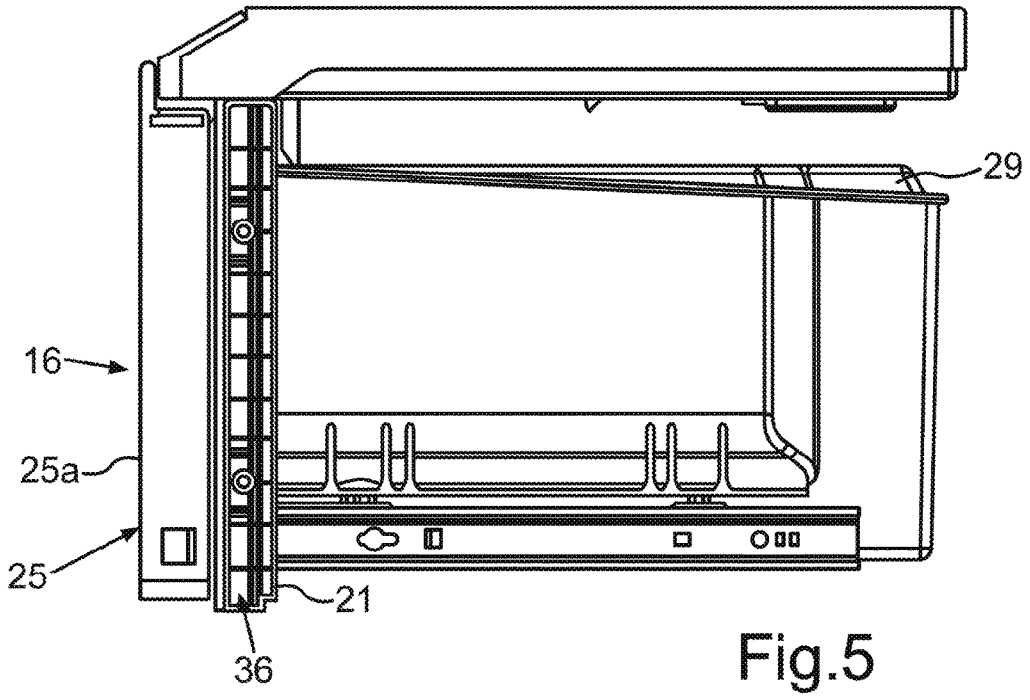
FIG. 5 is a side view of the embodiment shown in FIG. 4.
Figure 9:
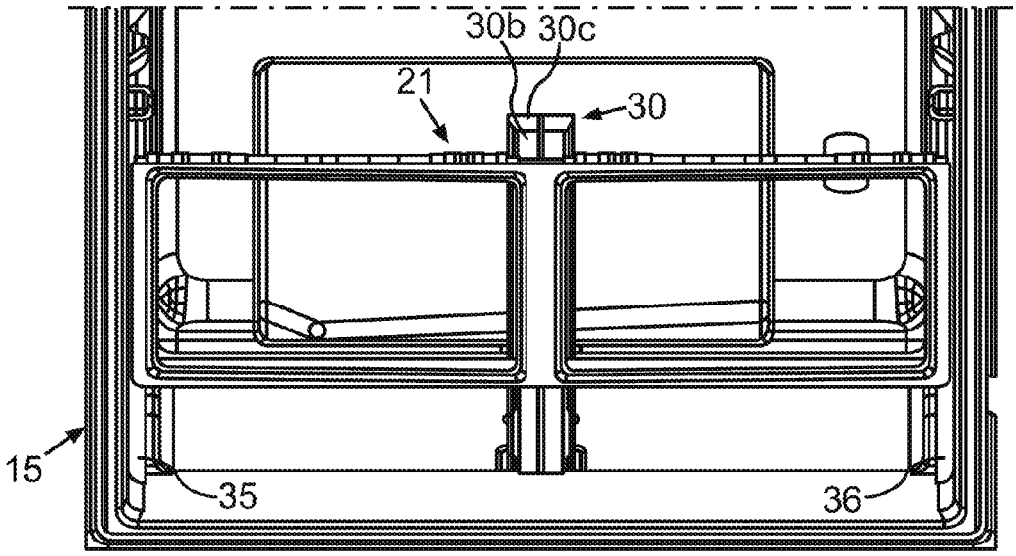

FIG. 9 is a front view of the components shown in FIG. 2, wherein in this case the frame 21 is shown in the interim assembly position on the holding rods 35 and 36 as shown in FIG. 8.

In this case, the partition wall 30 has already been assembled in advance and arranged in its end position. As can be identified in this case, the frame 21 is preferably also fastened to this partition wall 30. To this end, a receptacle 40, which can be a recess or a trough or a groove, is also formed on a rear side of an intermediate web 39 (FIGS. 7, 8) of the frame 21. The partition wall 30 also comprises on its front side 30*c* a holding-rod element 30*b*, which then engages in this receptacle 40 when the frame 21 is pushed onto the holding rods 35 and 36 and the partition wall 30 is assembled in advance.

Figure 10:
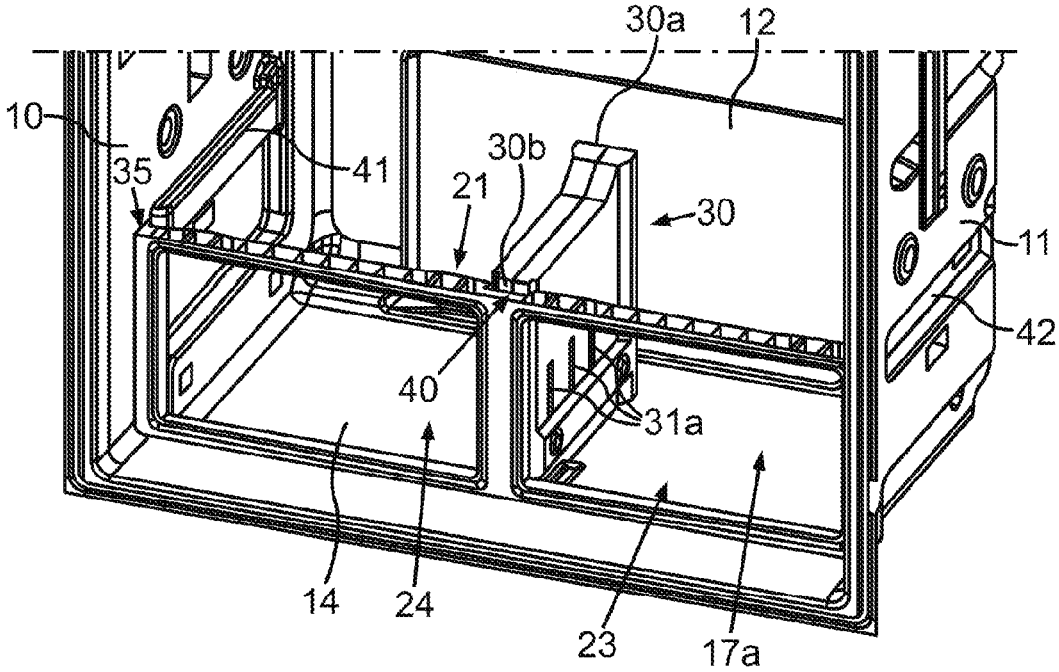

To this end, FIG. 10 is a perspective view of the assembled final state of the frame 21, wherein in this case it is then also possible to identify the engagement of the element 30*b* into this receptacle 40. The partition wall 30 can be inserted or latched or screwed onto the floor 14. It is also correspondingly possible for a connection with the rear wall 12 be provided or it is also possible in this case for it to be provided that a rear side or the rear edge 30*a* of the partition wall 30 only lies on as large an area as possible of the rear wall 12.

In FIG. 10, it is also possible to identify further bearing webs 41 and 42 on the side walls 10 and 11 which are molded-on in one piece. In particular, it is then possible for the top wall 18 of the additional compartment 16 to be placed on these webs 41 and 42.

Figure 11:
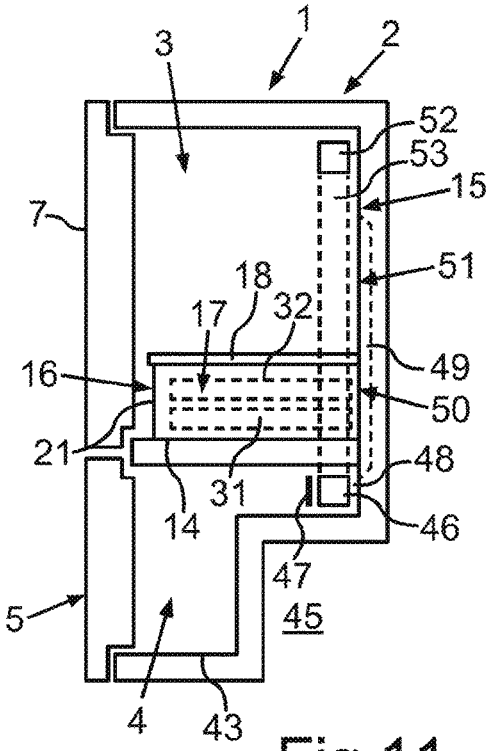

FIG. 11 is a simplified vertical sectional view (cutting plane corresponds to the y-z-plane) of a domestic refrigeration appliance 1 with which the additional compartment 16 is arranged in a first defined installation position in the height-wise direction. In this case, the floor 14 is a thermally insulating partition wall, in particular of the interior container 15, with which the chiller compartment 3 is separated from the freezer compartment 4. The air duct 31 is shown here. The receiving volume 17 can be an inherently interconnected receiving volume and hence it is possible for the partition wall 30 not to be present. If the partition wall 30 is optionally present, it is then possible for cold air and/or air provided with the corresponding atmospheric humidity to be introduced into the partial volume 17*b* via the air duct 31 in the partition wall 30 via corresponding openings 31*a* (FIG. 10).

Figure 12:
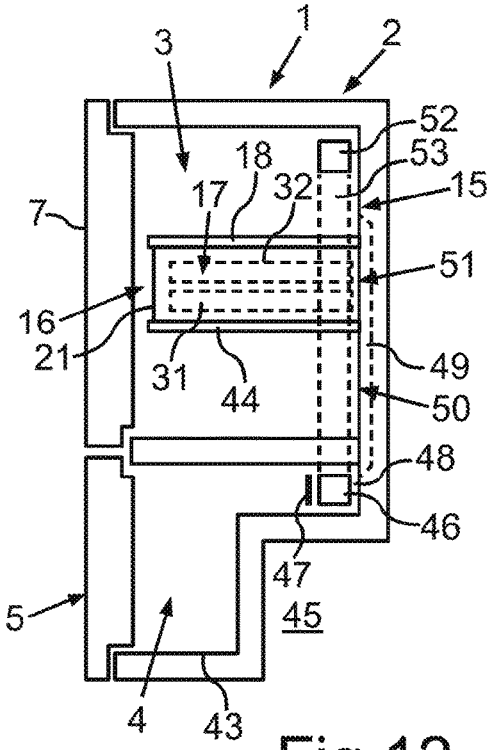

FIG. 12 is a vertical sectional view corresponding to FIG. 11 showing a further exemplary embodiment or a further type of installation in which the additional compartment 16 is assembled in a defined second position or installation position different from FIG. 11 in the chiller compartment 3. This modular assembly of the additional compartment 16 with the separate delimiting walls also enables different positions in the chiller compartment 3 to be specified at which this assembly of the additional compartment 16 is enabled. As can be identified in this case, when viewed in the height-wise direction, the second position is above the first position shown in FIG. 11. A floor of the additional compartment 16 is in this case formed by a, in particular freely projecting, compartment floor 44. Supplementary to the two different height positions shown by way of example in FIGS. 11 and 12, it is also possible for further height positions to be provided and/or additionally also for different positions to be provided for the additional compartment 16 in the depth-wise direction at which it can be assembled.

The delimiting walls of the additional compartment 16 are preferably thermal insulation walls which have the result that no unwanted alignment of the storage conditions in the additional compartment 16 with those in the remaining volume of the chiller compartment 3 occurs. The frame 21 is then also correspondingly advantageous formed as a thermally insulated wall of this kind.

Once again, with this embodiment, a floor 43 of the interior container 15 is the floor of the chiller compartment 4.

It is in particular provided that the domestic refrigeration appliance 1 comprises a refrigeration circuit some of the components of which can be arranged in a machine room 45 of the domestic refrigeration appliance 1. As can be identified in the exemplary embodiment shown in FIG. 11 and FIG. 12, an evaporator 46 of this refrigeration circuit 45 is arranged in the freezer compartment 4 but separated therefrom by a partition wall 47. As a result, an evaporation chamber 48 is formed. In particular, a fan (not shown) is preferably also arranged in this evaporation chamber 48 which blows air cooled on the evaporator 46 into the freezer compartment 4 and through a duct 49 extending in the rear wall of the interior container 15 into the chiller compartment 3.

This duct 49 terminates at an outlet 50. Preferably, a first outlet 50 and a second outlet 51 are provided so that, in this case, coupling of the duct 49 to the air ducts 31 and 32 at different heights is enabled. It can be provided that the outlets 50 and 51 can, for example, be closed by self-closing flaps. As a result, when assembling the additional compartment 16 at the first position shown in FIG. 11, the air ducts 31 and 32 can be coupled at the outlet 50 and then this flap sealing the outlet 50 can open, for example automatically, in particular on the insertion of the partition wall 30. In this position shown in FIG. 11, the flap sealing the outlet 51 is then closed. If on the other hand, the assembly of the additional compartment 16 is provided at the further position shown in FIG. 12, this flap sealing the outlet 51 is open, while the flap sealing the outlet 50 is closed.

Air from the chiller compartment 3 is guided through a further through-opening 52 via a duct 53, in particular extending in a side wall of the housing 2 back to the evaporation chamber 48.

It can also be provided that the cold air flowing via the air ducts 31 and 32 into the partial volumes 17*a* and 17*b* between for example a front edge of the top wall 18 and the feed-through openings 22 and 23 reaches the remaining volume of the chiller compartment 3 if an embodiment is provided there which does not require tightness such as that explained with the above example and hence a certain exchange of atmospheric humidity and/or temperature between the receiving volume 17 and the remaining regions of the chiller compartment 3 is to be provided.

Figure 13:
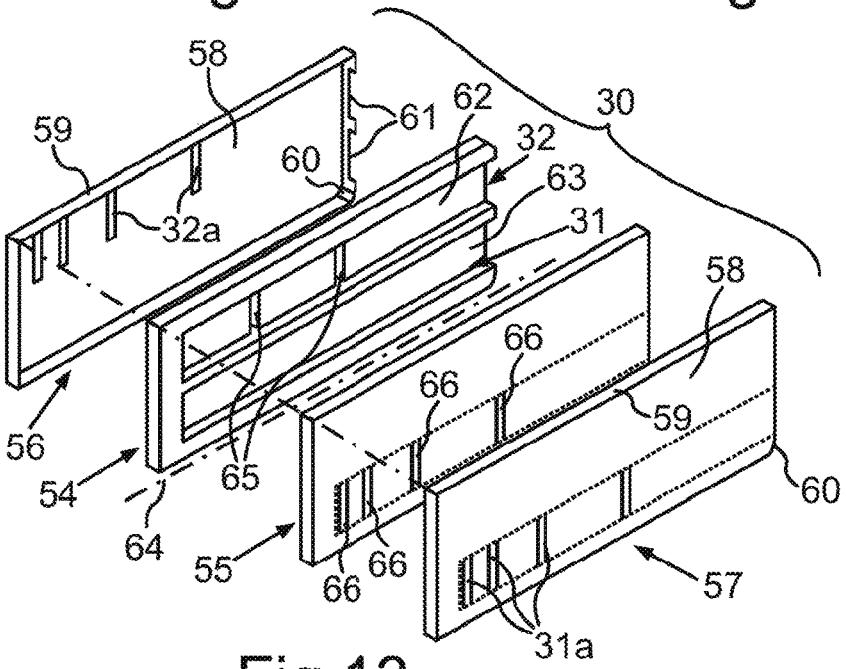

Instead of the two separate air ducts 31 and 32, it is also possible for one single duct to be provided in the partition wall 30 which then preferably comprises outlet openings 31*a* on both sides so that both partial volumes 17*a* and 17*b* can be correspondingly supplied with the same cold and/or moist air. However, preferably these two separate air ducts 31 and 32 are provided. As already explained, this partition wall 30 can be formed in one piece. However, it can also be formed in multiple pieces and, for example, formed as explained as explained with reference to FIG. 13. In this case, it can be provided that the separate components of this partition wall 30 in are in particular four components that are joined together. To this end, two in particular identical insulating bodies 54 and 55 can be provided. These can be made of a heat-insulating material, such as, for example, expanded polystyrene. Moreover, it is also possible for two drawer parts 56 and 57 to be provided representing outer closing plates and surrounding the insulating bodies 54 and 55 and hence so-to-speak forming a sleeve for these insulating bodies 54 and 55. These drawer parts 56 and 57 are in particular made of solid plastic. The drawer parts 56 and 57 preferably each have a, in particular flat, baseplate 58 which each form one of the edges of the partition wall 30 and are formed in the air-passage openings 31*a* and 32*a*. The baseplates 58 are framed by a peripheral web 59. At a lower rear corner 60, the drawer parts 56 and 57 are preferably blunted or rounded-off so that it can be suitably used with an exact fit to the, in particular rounded-off, transition on a thermoformed interior container 15 between a rear wall 12 and a floor 16. In the rear section of the web 59, in each case two recesses 61 are formed on two drawer parts 56 and 57 in alignment with the air ducts 31 and 32.

The insulating bodies 54 and 55 preferably are each configured as flat pareliepipeds on the main surfaces on the mutually facing surfaces of which two horizontally extending grooves 62 and 63 are formed as recesses, wherein the upper groove 62 is in alignment with the air-passage openings 32*a* in the upper half of the drawer part 56. The insulating body 55 only differs from the insulating body 54 in its orientation. They can both be converted into one another by a 180° rotation about a horizontal axis 64 so that one air duct 31 or 32 is delimited by an insulating body 54, 55 on the groove 62 and the other on the groove 63. Through-openings 65 in the insulating body 54 are in alignment with air-passage openings 32*a*. Correspondingly, through-openings 66 in the insulating body 55 are in alignment with the air-passage openings 31*a*.

LIST OF REFERENCE NUMBERS

1 Domestic refrigeration appliance
2 Housing
3 Chiller compartment
4 Freezer compartment
5 Door
6 Door
7 Door
8 Compartment floor
9 Compartment floor
10 Wall
11 Wall
12 Rear wall
13 Top wall
14 Bottom wall
15 Interior container
16 Additional compartment
17 Receiving volume
17*a* Partial volume
17*b* Partial volume
18 Top wall
19 Storage chamber
20 Front wall
20*a* Front side
21 Frame
22 Feed-through opening
23 Feed-through opening
24 Receiving drawer
24*a* Front wall
25 Receiving drawer
25*a* Front wall
26 Sealing element
27 Sealing element
28 Lid
29 Lid
30 Partition wall
30*a* Rear edge
30*b* Holding-rod element
30*c* Front side
31 Air duct
31*a* Air-passage opening
32 Air duct

32*a* Air-passage opening
33 Stiffening structure
34 Strut
35 Holding rod
36 Holding rod
37 Receptacle
38 Receptacle
39 Intermediate web
40 Recess
41 Bearing web
42 Bearing web
43 Floor
44 Compartment floor
45 Refrigeration circuit
46 Evaporator
47 Partition wall
48 Evaporation chamber
49 Duct
50 Outlet
51 Outlet
52 Through-opening
53 Duct
54 Insulating body
55 Insulating body
56 Drawer part
57 Drawer part
58 Baseplate
59 Web
60 Rear corner
61 Recess
62 Groove
63 Groove
64 Horizontal axis
65 Through-opening
66 Through-opening

The invention claimed is:

1. A domestic refrigeration appliance with a housing in which a receiving chamber for foodstuffs is formed, which is delimited by chamber walls of an interior container and with an additional compartment for foodstuffs formed in the receiving chamber comprising delimiting compartment walls by means of which a receiving volume of the additional compartment is delimited from a remaining volume of the receiving chamber, at least one of the compartment walls formed by a chamber wall of the interior container, wherein the delimiting compartment walls can be separated and joined non-destructively, thus enabling the additional compartment to be reversibly assembled and disassembled in the receiving chamber, wherein a first position for the additional compartment in the receiving chamber is specified and a second position different therefrom is specified for the additional compartment, wherein the additional compartment can be assembled at the first position in the receiving chamber or can be assembled at the second position in the receiving chamber.

2. The domestic refrigeration appliance as claimed in claim 1, wherein the additional compartment is a keep-fresh compartment in which (1) an atmospheric humidity different to that in the receiving chamber can be set selectively, and/or (2) a temperature different to that in the receiving chamber can be set selectively.

3. The domestic refrigeration appliance as claimed in claim 1, wherein the position can be selected in dependence on which wall of the interior container is to embody which locally specific delimiting wall of the additional compartment.

4. The domestic refrigeration appliance as claimed in claim 1, wherein in the height-wise direction (y) of the domestic refrigeration appliance, the first position is arranged below the second position.

5. The domestic refrigeration appliance as claimed in claim 1, wherein the additional compartment comprises at least one further separate delimiting wall, which is a partition wall with which the receiving volume of the additional compartment can be separated into at least two partial volumes.

6. The domestic refrigeration appliance as claimed in claim 5, wherein the partition wall is a thermal insulation wall.

7. The domestic refrigeration appliance as claimed in claim 5, wherein the partition wall comprises at least one air duct with which cold air can be guided from outside of the additional compartment into the receiving volume of the additional compartment.

8. The domestic refrigeration appliance as claimed in claim 1, wherein the additional compartment comprises as a separate delimiting wall a frame with at least one feed-through opening said frame forming a front wall of the additional compartment.

9. The domestic refrigeration appliance as claimed in claim 8, wherein the frame comprises at least two separate feed-through openings formed next to one another in the width-wise direction (x).

10. The domestic refrigeration appliance as claimed in claim 8, wherein the additional compartment comprises at least one receiving drawer for foodstuffs, which is arranged so that it can be so that it can be pushed in and pulled out of the receiving volume formed by the delimiting walls through the feed-through opening.

11. The domestic refrigeration appliance as claimed in claim 10, wherein a sealing element surrounding a feed-through opening is arranged on a front side of the frame on which the receiving drawer lies in pushed-in state.

12. The domestic refrigeration appliance as claimed in claim 8, wherein the frame is pushed into separate holding rods on opposite sides.

13. The domestic refrigeration appliance as claimed in claim 1, wherein a delimiting wall is a wall of the interior container or a compartment floor, which is arranged in the receiving chamber so that it can be non-destructively detached and divides the receiving chamber.

14. The domestic refrigeration appliance as claimed in claim 1, wherein the additional compartment comprises as separate delimiting walls a front wall, a bottom wall, a top wall, a rear wall and side walls.

15. The domestic refrigeration appliance as claimed in claim 1, wherein the receiving chamber includes a first side chamber wall and an opposite second side chamber wall, and the additional compartment including a front compartment wall, wherein the front compartment wall is secured to the first side chamber wall and the second side chamber wall.

16. The domestic refrigeration appliance as claimed in claim 1, wherein in the first position the chamber wall forms at least one of the compartment walls and in the second position the chamber wall forms at least one of the compartment walls.

17. The domestic refrigeration appliance as claimed in claim 1, wherein the additional compartment is thermally insulated such that no unwanted alignment of storage conditions between the receiving volume of the additional compartment and the remaining volume of the receiving chamber occurs.

18. A domestic refrigeration appliance with a housing in which a receiving chamber for foodstuffs is formed, which is delimited by chamber walls of an interior container and with an additional compartment for foodstuffs formed in the receiving chamber comprising delimiting compartment walls by means of which a receiving volume of the additional compartment is delimited from a remaining volume of the receiving chamber, at least one of the compartment walls formed by a chamber wall of the interior container, wherein the delimiting compartment walls can be separated and joined non-destructively, thus enabling the additional compartment to be reversibly assembled and disassembled in the receiving chamber;

wherein the additional compartment comprises at least one further separate delimiting wall, which is a partition wall with which the receiving volume of the additional compartment can be separated into at least two partial volumes; and wherein the partition wall comprises at least one air duct with which cold air can be guided from outside of the additional compartment into the receiving volume of the additional compartment.

* * * * *